US008578683B2

(12) United States Patent
Smith

(10) Patent No.: US 8,578,683 B2
(45) Date of Patent: Nov. 12, 2013

(54) METHOD OF DISTRIBUTING PACKAGING MATERIAL FROM A ROLL OF MATERIAL HAVING A TUBULAR CORE VIA A PACKAGING TOOL

(75) Inventor: Steven L. Smith, Buford, GA (US)

(73) Assignee: United Parcel Service of America, Inc., Atlanta, GA (US)

( * ) Notice: Subject to any disclaimer, the term of this patent is extended or adjusted under 35 U.S.C. 154(b) by 55 days.

(21) Appl. No.: 13/018,979

(22) Filed: Feb. 1, 2011

(65) Prior Publication Data

US 2011/0120056 A1 May 26, 2011

Related U.S. Application Data

(62) Division of application No. 12/188,492, filed on Aug. 8, 2008, now Pat. No. 7,900,421.

(51) Int. Cl.
*B65B 11/00* (2006.01)
*B65B 67/08* (2006.01)

(52) U.S. Cl.
USPC ..... 53/399; 53/441; 53/556; 53/592; 53/390; 242/588.2

(58) Field of Classification Search
CPC ..... B65H 2402/41; B65H 2402/412; B65H 49/205; B65B 67/08; B65B 67/085
USPC ..... 53/588, 588.1, 588.2, 423, 423.1, 53/423.2, 399, 203, 218, 219, 390, 441, 53/556, 592; 242/588, 588.1, 588.2, 423, 242/423.1, 423.2, 422.4, 597.3, 597.7; 294/93, 97
IPC ..... B65B 67/08
See application file for complete search history.

(56) References Cited

U.S. PATENT DOCUMENTS 1,067,643 A * 7/1913 Christner et al. ..... 242/396.9
1,915,238 A * 6/1933 Mosher et al. ..... 242/396.1

(Continued)

FOREIGN PATENT DOCUMENTS

EP 81328 A2 * 6/1983 ..... B65B 11/02
EP 1241101 A1 * 9/2002 ..... B65B 67/08

(Continued)

OTHER PUBLICATIONS

Office Action dated Nov. 2, 2009 of related U.S. Appl. No. 12/188,492.

(Continued)

*Primary Examiner* — Stephen F Gerrity
(74) *Attorney, Agent, or Firm* — Alston & Bird LLP

(57) ABSTRACT

Packaging tools, which, in various embodiments, are adapted to assist a user in applying material from a roll of packaging material (e.g., packing tape, stretch wrap or shrink wrap) to an item or group of items. The packaging tool is typically adapted to move between: (1) a first orientation in which the packaging tool does not substantially restrict the rotation of the roll of packaging material adjacent the packaging tool; and (2) a second orientation in which the packaging tool does substantially restrict (e.g., prevent) the rotation of the roll of stretch wrap tool adjacent the packaging tool. A user typically maintains the packaging tool in the first orientation as the user wraps the packaging material about an item. The user may then move the packaging tool into the second orientation, which allows the user to pull the packaging material tight and separate the applied length of packaging material from the roll.

19 Claims, 7 Drawing Sheets

(56) References Cited

U.S. PATENT DOCUMENTS

| | | | | | |
|---|---|---|---|---|---|
| 2,104,111 | A | | 1/1938 | Barnett | |
| D152,478 | S | | 1/1949 | Hutchinson et al. | |
| 2,578,072 | A | | 12/1951 | Kargol | |
| 2,951,725 | A | | 9/1960 | St. Jean | |
| 2,961,184 | A | * | 11/1960 | Alford | 242/396.7 |
| 4,045,038 | A | | 8/1977 | Obenshain | |
| 4,102,513 | A | | 7/1978 | Guard | |
| 4,166,589 | A | | 9/1979 | Hoover et al. | |
| 4,223,935 | A | | 9/1980 | Rayner et al. | |
| 4,535,951 | A | | 8/1985 | Riemenschneider, III | |
| 4,575,020 | A | * | 3/1986 | Strout et al. | 242/422.1 |
| 4,600,163 | A | * | 7/1986 | Hummel et al. | 242/422.1 |
| 4,714,211 | A | | 12/1987 | Hwang | |
| 4,717,190 | A | | 1/1988 | Witherspoon | |
| 5,386,744 | A | | 2/1995 | Garcia | |
| 5,409,177 | A | * | 4/1995 | Parry et al. | 242/588 |
| 6,126,108 | A | * | 10/2000 | Bush | 242/588.2 |
| 6,470,657 | B2 | | 10/2002 | Huson et al. | |
| 6,659,390 | B2 | * | 12/2003 | Black | 242/588.2 |
| 6,739,542 | B1 | | 5/2004 | Prina et al. | |
| 6,902,133 | B1 | * | 6/2005 | Black | 242/588.2 |
| 6,948,679 | B1 | * | 9/2005 | Black | 242/588.2 |
| 7,543,426 | B1 | * | 6/2009 | Phero | 53/592 |
| 2007/0079578 | A1 | * | 4/2007 | Yu Chen | 53/592 |

FOREIGN PATENT DOCUMENTS

| | | | | | |
|---|---|---|---|---|---|
| GB | 2121001 | A | * | 12/1983 | B65H 75/30 |
| GB | 2192611 | A | * | 1/1988 | B65B 67/08 |
| GB | 2203726 | A | * | 10/1988 | B65H 23/08 |
| GB | 2209325 | A | * | 5/1989 | B65H 67/08 |

OTHER PUBLICATIONS

Office Action dated Apr. 2, 2010 of related U.S. Appl. No. 12/188,492.

Office Action dated May 24, 2010 of related U.S. Appl. No. 12/188,492.

Notice of Allowance dated Nov. 1, 2010 of related U.S. Appl. No. 12/188,492.

* cited by examiner

METHOD OF DISTRIBUTING PACKAGING MATERIAL FROM A ROLL OF MATERIAL HAVING A TUBULAR CORE VIA A PACKAGING TOOL

CROSS-REFERENCE TO RELATED APPLICATIONS

This application is a divisional of and claims priority to U.S. application Ser. No. 12/188,492, filed Aug. 8, 2008, entitled "Packaging Tools," and now U.S. Pat. No. 7,900,421, the contents of which are hereby incorporated herein in their entirety by reference.

BACKGROUND

Before transporting items, such as groups of packages, it is often desirable to wrap the packages in a packaging material, such as stretch wrap or shrink wrap. This helps to keep groups of items together in bundle and also provides protection for the items. Current methods for applying packaging material are cumbersome and often require two hands to implement. Accordingly, there is a need for improved methods and apparatus for applying packaging materials.

SUMMARY

In one embodiment, a packaging tool for rotatably supporting a roll of packaging material having a hollow, at least substantially tubular core is provided. The packaging tool includes a first base and a second base, a first elongate support member extending outwardly relative to a surface of the first base, a second elongate support member extending outwardly relative to a surface of the second base, and an actuation mechanism. The actuation mechanism is adapted to move the packaging tool between a first orientation and a second orientation. In various embodiments: (1) when the packaging tool is in the first orientation, a roll engaging portion of the first elongate support member is positioned a first distance apart from a roll engaging portion of the second elongate support member; and (2) when the packaging tool is in the second orientation, the respective roll engaging portions of the first and second elongate support members are separated by a second distance, where the second distance is greater than the first distance. Also, the packaging tool may be adapted so that the first and second elongate support members may be positioned at least partially within a tubular core of a roll of packaging material and moved between the first and second orientations while the first and second elongate support members are disposed at least partially within the tubular core. In particular embodiments, when the first and second elongate support members are positioned at least partially within the tubular core and the packaging tool is in the first orientation, the roll of packaging material is free to rotate. Also, in various embodiments, when the first and second elongate support members are positioned at least partially within the tubular core and the packaging tool is in the second orientation, the first and second elongate support members cooperate to at least substantially prevent the roll of packaging material from rotating.

An apparatus according to a further embodiment of the invention includes a roll of packaging material having a hollow, at least substantially tubular, core and a packaging tool for rotatably supporting the roll of packaging material. The packaging tool includes a first base and a second base, a first elongate support member extending outwardly relative to a surface of the first base, a second elongate support member extending outwardly relative to a surface of the second base, and an actuation mechanism. The actuation mechanism is adapted to move the packaging tool between a first orientation and a second orientation. In various embodiments: (1) when the packaging tool is in the first orientation, a roll engaging portion of the first elongate support member is positioned a first distance apart from a roll engaging portion of the second elongate support member; and (2) when the packaging tool is in the second orientation, the respective roll engaging portions of the first and second elongate support members are separated by a second distance, where the second distance is greater than the first distance. Also, in particular embodiments, the packaging tool is adapted so that the first and second elongate support members may be positioned at least partially within the tubular core and moved between the first and second orientations while the first and second elongate support members are disposed at least partially within the tubular core. In various embodiments, when the first and second elongate support members are positioned at least partially within the tubular core and the packaging tool is in the first orientation, the roll of packaging material is free to rotate. When the first and second elongate support members are positioned at least partially within the tubular core and the packaging tool is in the second orientation, the first and second elongate support members cooperate to at least substantially prevent the roll of packaging material from rotating.

In another embodiment, a method of distributing packaging material from a roll of packaging material is provided. The method includes providing a roll of packaging material and loading the roll of packaging material onto a packaging tool that is adapted to selectively at least substantially prevent the rotation of the packaging material about a central axis of the roll of packaging material. The method also includes attaching an end portion of the packaging material to an object and then moving the packaging tool so that (A) the roll of packaging material rotates and (B) as the roll of packaging material rotates, a length of the packaging material adjacent the end portion peals off of the roll of packaging material and attaches to the object. In various embodiments, after the packaging material attaches to the object, the packaging tool may be moved from: (1) a first orientation, in which the packaging tool does not substantially restrict the rotation of the roll of packaging material about the central axis; to (2) a second orientation, in which the packaging tool substantially prevents the rotation of the roll of packaging material about the central axis. The method further includes separating the length of packaging material from the roll of packaging material.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 9A:
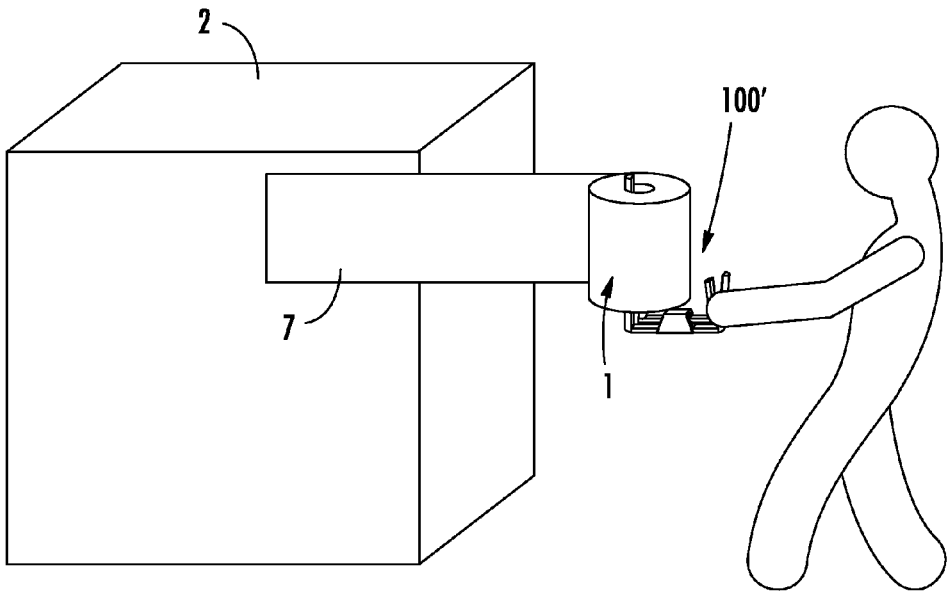
Figure 9B:
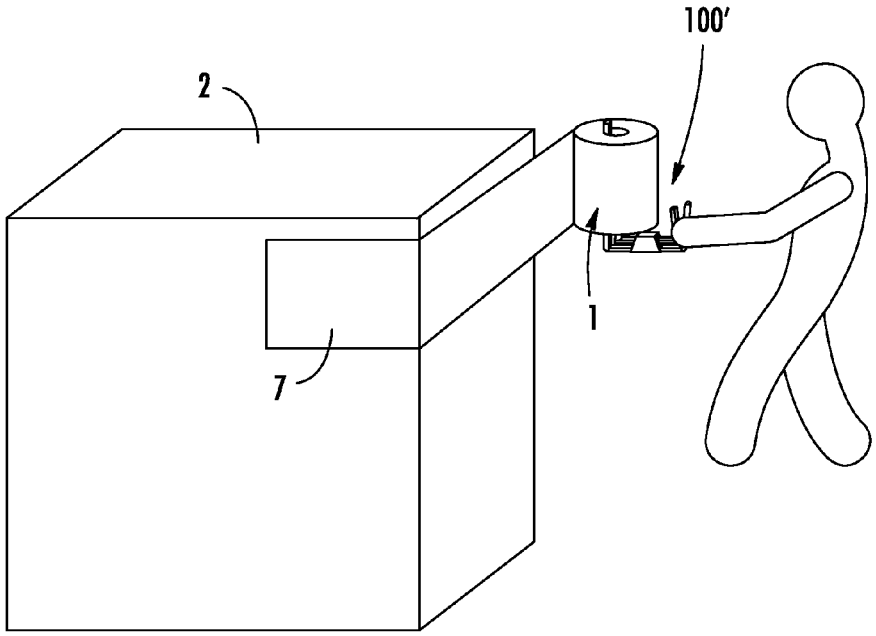

FIGS. 9A-B show perspective views of a user applying packaging material with a packaging roll.

DETAILED DESCRIPTION

The embodiments will now be described more fully hereinafter with reference to the accompanying illustrations, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Figure 1:
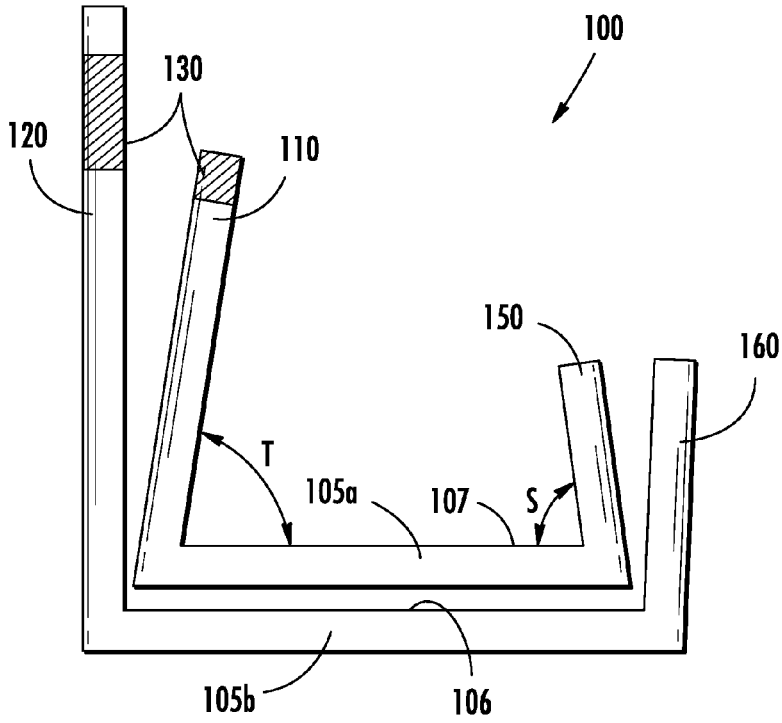
FIG. 1 is a side view of a packaging tool according to one embodiment of the invention.
Figure 2:
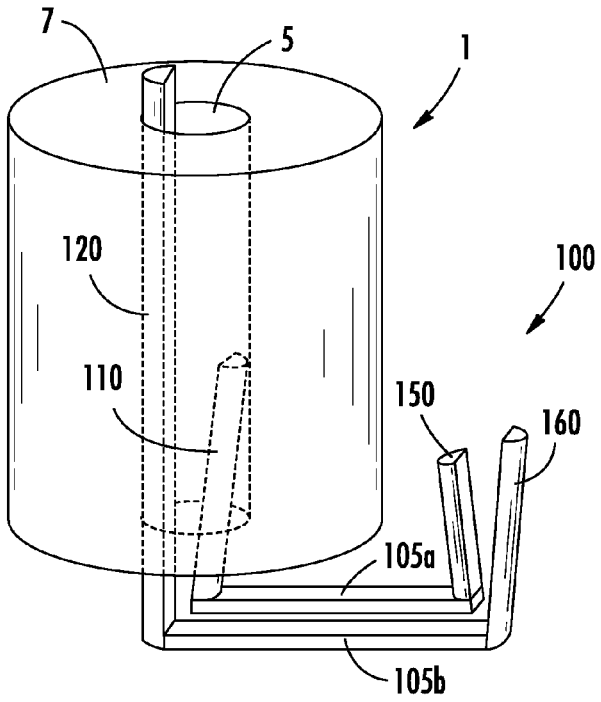
FIG. 2 is a perspective view of a roll of packaging material supported by a packaging tool.

Referring now to FIG. 1, there is shown a packaging tool 100. Although the embodiment of the packaging tool 100 depicted in FIG. 1 and described below represents one configuration, the packaging tool 100 and the associated method of using the packaging tool 100 may have other configurations. While packaging tools 100 are commonly employed to unitize pallet loads, they may be used in other applications if so desired. Generally, packaging tools 100 are configured to support a roll of packaging material and distribute and apply packaging material to various objects, such as packages or pallet loads. For example, as shown in FIG. 2, a roll of packaging material 1 is supported on a packaging tool 100. FIG. 2 shows the typical configuration of a roll of packaging material 1 including a hollow tube 5 (sometimes called a support tube or tubular core) with packaging material 7, such as plastic film, wrapped tightly around the exterior of the tube 5. Of course, a roll of packaging material 1 may have other configurations.

Referring to FIG. 1, the packaging tool 100 may include a first base 105*a* and a second base 105*b*, a first elongate support member 110 extending outwardly relative to a surface of the first base 105*a*, a second elongate support member 120 extending outwardly relative to a surface of the second base 105*b*, and an actuation mechanism, which may include first and second handles 150, 160. The first base 105*a*, first elongate support member 110, and first handle 150 may comprise a substantially U-shaped structure with the first elongate support member 110 and first handle 150 extending perpendicularly or at an angle relative to a surface of the first base 105*a*. Accordingly, the structure including the first base 105*a*, first elongate support member 110, and first handle 150 is hereinafter called the "inner U-shaped member", although an inner U-shaped member according to other embodiments may take other forms. The second base 105*b*, the second elongate support member 120, and the second handle 160 may comprise a substantially U-shaped structure with the second elongate support member 120 and second handle 160 extending at an angle (e.g., 90 degrees) relative to a surface of the second base 105*b*. Accordingly, the structure including the second base 105*b*, second elongate support member 120, and second handle 160 is hereinafter called the "outer U-shaped member", although an outer U-shaped member according to other embodiments may take other forms.

Inner U-Shaped Member

The first elongate support member 110 may extend outwardly at various angles relative to a surface of the first base 105*a*. In FIG. 1, for instance, the first elongate support member 110 extends from the first base 105*a* at an angle T to the surface 107 of the first base 105*a*. The first handle 150 may extend perpendicularly from the first base 105*a*. Alternatively, as shown in FIG. 1, the first handle 150 may extend from the first base 105*a* at an angle S relative to the surface 107 of the first base 105*a*.

The first elongate support member 110 may be attached to the first base 105*a* by rivets, welds, or the like. Alternatively, the first base 105*a* and first elongate support member 110 may be parts of the same structure. In FIG. 1, for example, the first base 105*a* and first elongate support member 110 are a continuous structure. Typically, the first base 105*a* and first elongate support member 110 may have the same continuous structure and the same hollow, cylindrical (or semi-cylindrical) shape. Similarly, the first handle 150 may be connected to the first base 105*a* by welds, fastening devices, and the like. As shown in FIG. 1, the first handle 150 and first base 105*a* may be part of the same continuous structure. Accordingly, as shown in FIG. 1, the inner U-shaped member may be a continuous structure having a first base 105*a*, first elongate support member 110, and first handle 150.

The cross-section of the first base 105*a* may be various shapes, including circular, rectangular, or oval. Accordingly, the first base 105*a* of the packaging tool 100 may be a hollow, cylindrical structure. Alternatively, the first base 105*a* of the packaging tool 100 may be a solid structure. The first base 105*a* may be formed of various materials, such as metal, graphite, or plastic. Typically, the first base 105*a* may be molded from a light, strong, and stiff material, such as fiber reinforced plastic. It should be noted that the first base 105*a* may have other configurations and may vary in size and shape.

The cross-section of the first elongate support member 110 may be various shapes, such as circular, rectangular, or oval. As such, the first elongate support member 110 may be a hollow, cylindrical structure. Alternatively, the first elongate support member 110 may be a solid structure. The first elongate support member 110 may be formed of various materials, such as metal, graphite, or plastic. Typically, the first elongate support member 110 may be molded from a light, strong, and stiff material, such as fiber reinforced plastic. Of course, the first elongate support member 110 may have other configurations and may vary in size and shape.

The cross-section of the first handle 150 may be various shapes, such as circular, rectangular, or oval. As such, the first handle 150 may be a hollow, cylindrical structure. Alternatively, the first handle 150 may be a solid structure. The first handle 150 may be formed of various materials, such as metal, graphite, or plastic. Typically, the first handle 150 may be molded from a light, strong, and stiff material, such as fiber reinforced plastic. Of course, the first handle 150 may have other configurations and may vary in size and shape. For example, the first handle 150 may be ergonomically shaped for increased comfort for the user's hand.

Outer U-Shaped Member

The second elongate support member 120 may typically extend at least substantially perpendicular (and, in some embodiments, perpendicular) to the surface 106 of the second base 105*b* (see, for example, FIG. 1) but may extend at other angles to the surface 106 of the second base 105*b*. Typically, the second handle 160 is at least substantially perpendicular (e.g., perpendicular) to the second base 105*b*. However, the second handle 160 may extend at an angle relative to the surface 106 of the second base 105*b* that is greater or less than 90 degrees.

The second elongate support member 120 may be attached to the second base 105*b* by rivets, welds, or the like. Alternatively, the second base 105*b* and second elongate support member 120 may be parts of the same, continuous structure. In FIG. 1, for example, the second base 105*b* and second elongate support member 120 are a continuous structure. Typically, the second base 105*b* and second elongate support member 120 may have the same continuous structure and the same hollow, cylindrical (or semi-cylindrical) shape. The second handle 160 may be connected to the second base 105*b* by welds, fastening devices, and the like. Alternatively, as shown in FIG. 1, the second handle 160 and second base 105*b* may be part of the same continuous structure. Accordingly, as shown in FIG. 1, the outer U-shaped member may be a continuous structure including a second base 105*b*, second elongate support member 120, and second handle 160.

The cross-section of the second base 105*b* may be various shapes, including circular, rectangular, or oval. Accordingly, the second base 105*b* of the packaging tool 100 may be a hollow, cylindrical structure. Alternatively, the second base 105*b* of the packaging tool 100 may be a solid structure. The second base 105*b* may be formed of various materials, such as metal, graphite, or plastic. Typically, the second base 105*b* may be molded from a light, strong, and stiff material, such as fiber reinforced plastic. It should be noted that the base 105*b* may have other configurations and may vary in size and shape.

The cross-section of the second elongate support member 120 may be various shapes, such as circular, rectangular, or oval. As such, the second elongate support member 120 may be a hollow, cylindrical structure. Alternatively, the second elongate support member 120 may be a solid structure. Also, the second elongate support member 120 may be formed of various materials, such as metal, graphite, or plastic. Typically, the second elongate support member 120 may be molded from a light, strong, and stiff material, such as fiber reinforced plastic. In various embodiments, the second elongate support member 120 may have other configurations and may vary in size and shape.

As shown in FIG. 1, the second handle 160 may be a hollow, cylindrical structure. Alternatively, the second handle 160 may be a solid structure. Also, the second handle 160 may be formed of various materials, such as metal, graphite, or plastic. Typically, the second handle 160 may be molded from a light, strong, and stiff material, such as fiber reinforced plastic. The second handle 160 may have other configurations and may vary in size and shape. For example, the second handle 160 may be ergonomically shaped for increased comfort for the user's hand.

Connection of U-Shaped Members

Figure 3A:
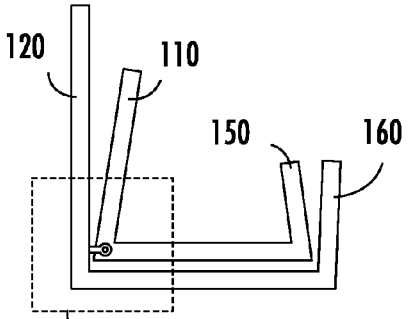
FIG. 3A is a side view of a packaging tool according to another embodiment of the invention.

The outer and inner U-shaped members may be connected to each other using various devices. The U-shaped members may, for example, be pivotably connected to each other, such as by using a pivot device 125 (see FIG. 3A). The pivot device 125 may include a pin 126*a* that is attached to the inner U-shaped member and at least one bar 126*b* connecting the outer U-shaped member to the pin 126*a*. In various embodiments, the pivot device 125 is adapted to permit the inner U-shaped member to rotate about the axis defined by the pin 126*a* but restrict the translational movement of the inner U-shaped member relative to the outer U-shaped member. As shown in FIG. 3A, a pin 126*a* may be attached to the inner U-shaped member where the first elongate support member 110 meets the first base 105*a*. A pin 126*a* may be attached to other parts of the inner U-shaped member. A typical pin 126*a* may be a solid cylinder formed of metal. Other types and shapes of pins 126*a* may be used. A pin 126*a* may be attached to the inner U-shaped member using an adhesive, fastening device, or the like. The pin 126*a* may also be inserted into the inner U-shaped member such that a portion of the pin 126*a* is sticking out of the U-shaped member.

One or more bars 126*b* typically connect the pin 126*a*, and therefore the inner U-shape tube, to a portion of the second elongate support member 120. A bar 126*b* may have a hook, a hole, or the like on one of its ends that is adapted to receive and secure a pin 126*a*. FIG. 3B shows an enlarged view of the pivot device 125 connecting the outer U-shaped member and the inner U-shaped member. In FIG. 3B, the bar 126*b* includes a washer-like end portion. As shown in FIGS. 3A and 3B, the pin 126*a* may be secured within the opening of the washer-like end portion of the bar 126*b*. As such, the pin 126*a* and inner U-shaped member may not be able to move with respect to the outer U-shaped member. A bar 126*b* may have other shapes and may be formed of various materials, such as plastic or metal. The one or more bars 126*b* may be attached to the second elongate support member 120 by way of adhesives, fastening devices, or the like.

Figure 3C:
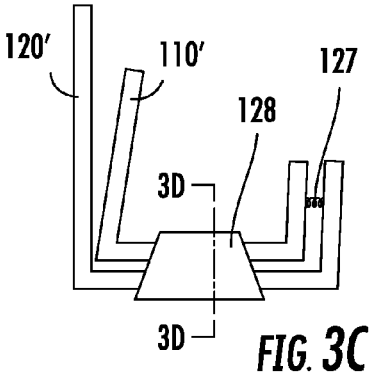
FIG. 3C is a side view of a packaging tool according to another embodiment of the present invention.
Figure 3B:
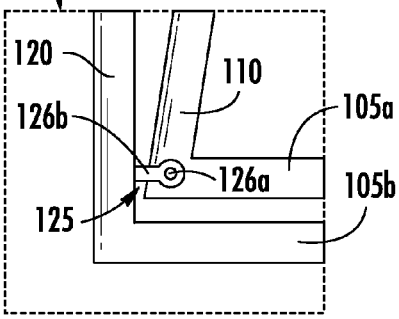
FIG. 3B is an enlarged side view of a pivot device attached to the first elongate support member and the second elongate support member.
Figure 3D:
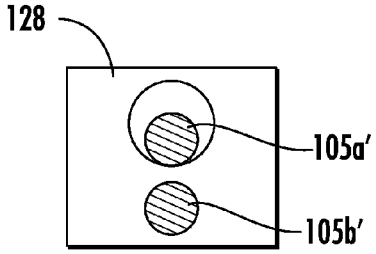
FIG. 3D is a sectional view of the support system in FIG. 3C taken about the plane labeled 3D in FIG. 3C.

As shown in FIG. 3C, the inner U-shaped member may be translationally connected to the outer U-shaped member using a support system 128 or other system. A support system 128 may be configured to support the outer U-shaped member and the inner U-shaped member. FIG. 3D shows a cross section of the support system 128 of FIG. 3D with the first base 105*a*' positioned within an opening of the support system 128 and the second base 105*b*' attached to the support system 128. The second base 105*b*' may be attached to the support system 128 by a fastening device, adhesive, or the like. The support system 128 may also be configured such that at least a portion of the first base 105*a*' may be mounted to the support system 128 along a rail, track, or the like of the support system 128. In any case, the support system 128 may provide support to the inner U-shaped member and permit the translational movement of the inner U-shaped member along the direction defined by the longitudinal axis of the first base 105*a*'. The support system 128 may have other shapes and structures. For instance, the support system 128 may include two washer-like components connected together at a point on the perimeter of each component, such that the washer-like components are configured to receive, support, and separate, at a defined distance, the first and second bases 105*a*', 105*b*'. The support system 128 may be formed of plastic, metal, or the like.

Generally, as shown in FIG. 1, the inner U-shaped member may be substantially in the same plane as the outer U-shaped member. Furthermore, the inner U-shaped member may typically be nested, as shown in FIG. 1, with the outer U-shaped member. In other words, the first base 105*a* may be adjacent to the second base 105*b*, the first elongate support member 110 may be adjacent to the second elongate support member 120, and the first handle 150 may be adjacent to the second handle 160. As shown in FIG. 1, the first elongate support member 110 may be slanted or angled away from the second elongate support member 120. The elongate support members 110, 120 may, on the other hand, be parallel to each other. The first and second elongate support members 110, 120 are generally designed to have shapes and sizes such that both can be at least partially disposed within the tubular core 5 of a roll of packaging material 1 at the same time. Furthermore, the support members 110, 120 are configured to be positioned near each other such that both can fit within the tubular core 5 at the same time.

Figure 4A:
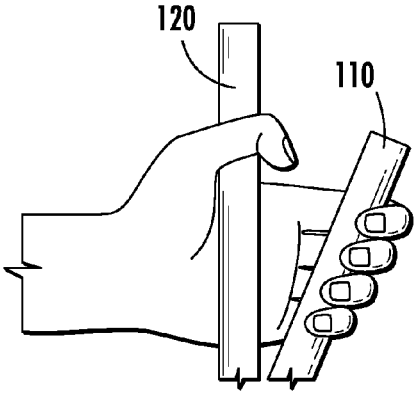
FIG. 4A is a side view of one hand of a user controlling first and second handles of a packaging tool.
Figure 4B:
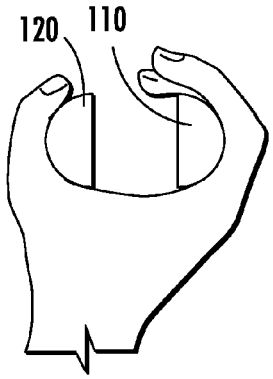
FIG. 4B is a top view of one hand of a user controlling first and second handles of a packaging tool.

The first and second handles 150, 160 may be sized and shaped such that a user may control both handles 150, 160 with one hand and be able to move the first handle 150 without requiring the use of another hand. See, for example, FIGS. 4A and 4B. As shown in FIGS. 4A and 4B, the handles 150, 160 may be positioned adjacent each other and have cross-sections that are small enough for one of a user's hands to wrap at least partially around both handles 150, 160 at the same time. Consequently, the user can make use of the user's free hand for other tasks, such as to cut the packaging material 7, move packages to more suitable positions for wrapping, or the like. As described below, with one hand, a user of the packaging tool 100 can adjust the friction applied to a roll of packaging material 1 on the fly, as well as keep the tool 100 stabilized.

Roll Engaging Portions

Each elongate support member 110, 120 may contain a roll engaging portion 130 that may provide friction upon engaging an interior portion of the tubular core 5. As depicted in FIG. 1, a roll engaging portion 130 may typically be located at or near the end of at least one of the members 110, 120. However, roll engaging portions 130 may be located anywhere on either member 110, 120. Roll engaging portions 130 may include a high friction surface, a low friction surface, or other types of surfaces. Roll engaging portions 130 may be devices that are wrapped around the support members 110, 120 and secured thereto, such as with glue, rivets, welds, or the like. Alternatively, the roll engaging portions 130 may be formed out of or integrated with the support members 110, 120. For example, the support members 110, 120 may be stamped, carved, or the like to form roll engaging portions 130 in the support members 110, 120.

Supporting a Packaging Roll

A packaging roll 1 may be supported by one or both of the first and second elongate support members 110, 120 and/or at least one of the first and second bases 105*a*, 105*b*. For example, the first base 105*a* may support the weight of the packaging roll 1 by supporting an end of the packaging roll 1. The first and second elongate support members 110, 120 may substantially restrict lateral movement of the packaging roll 1 by being disposed within the tubular core 5 of the packaging roll 1.

A packaging roll 1 may be supported by other arrangements and devices, such as packaging supports 50. A packaging support 50 may be a half-disk or similar device with a width that is at least the same distance as the distance from the second elongate support member 120 to a portion of the hollow tube 5. Since the second elongate support member 120 may shift positions, particularly during application of packaging material 7, the packaging support 50 may typically have a width that is at least the same distance as the maximum distance possible between the second elongate support member 120 and a portion of the hollow tube 5. The maximum distance possible between the second elongate support member 120 and a portion of the hollow tube 5 would basically be about the diameter of the hollow tube 5. The packaging support 50 may be a full disk with a radius that is about equal to the radius of the hollow tube 5.

The full disk may have a cutout for the first elongate support member 110. Packaging supports 50 may be secured to the elongate support members 110, 120 and/or the first and second bases 105*a*, 105*b* by welds, fastening devices including screws, and the like and may extend substantially perpendicular to the longitudinal axis of the second elongate support member 120. A packaging support 50 that is attached to the second elongate support member 120 may be sized such that at least a portion of the packaging support 50 extends from the second elongate support member 120 beyond, for example, a portion of the hollow tube 5 and, possibly, a portion of the packaging material 7 of the roll of packaging material 1.

Figure 5:
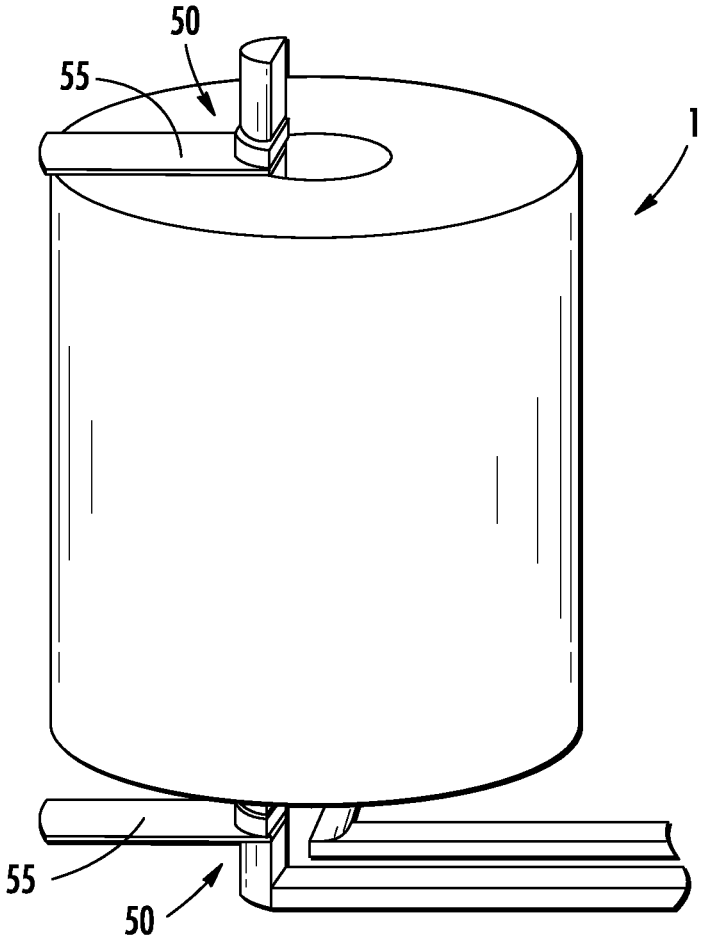
FIG. 5 is a perspective view of packaging supports supporting a roll of packaging. In this figure, the elongate support members of the packaging tool are shown partially disposed within the roll of packaging material and support members are shown attached to the second elongate support member.

Packaging supports 50 may be formed of various materials, such as metal, plastic, and the like. Packaging supports 50 may include tabs 55, such as flat panel devices, rod-like structures, and the like, made of various materials, such as metal, plastic, and the like. Tabs 55 may be attached to the second elongate support member 120 or a part of the packaging support 50, such as a disk, that is attached to the second elongate support member 120. Tabs 55 may extend from the second elongate support member 120 beyond a portion of the packaging material 7. As shown in FIG. 5, for example, packaging supports 50 may be configured to support a roll of packaging material 1. In FIG. 5, the packaging supports 50 include tabs 55 that extend out from the second elongate support member 120 to contact the roll of packaging material 1 on both ends of the roll 1. The tabs 55 are sufficiently rigid and strong to prevent or substantially restrict the longitudinal movement of the roll of packaging material 1.

Application of Packaging Roll

Figure 6:
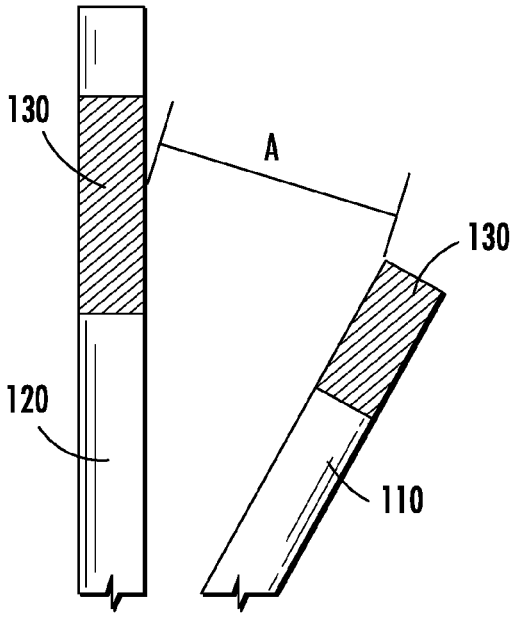
FIG. 6 is a side view of elongate support members of a packaging tool in a first orientation.
Figure 7:
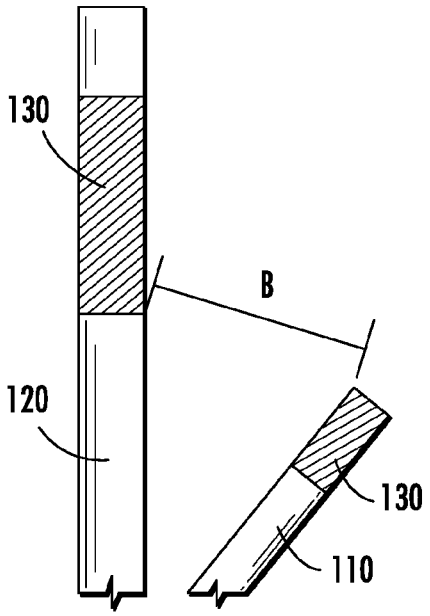
FIG. 7 is a side view of elongate support members shown in FIG. 6 in a second orientation.
Figure 8A:
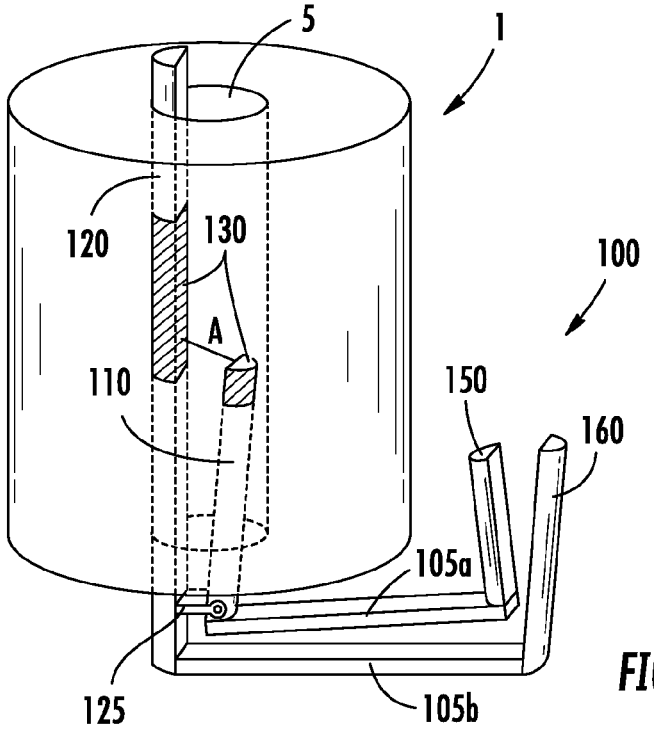
FIG. 8A is a perspective view of a packaging tool supporting a roll of packaging and in a first orientation.
Figure 8B:
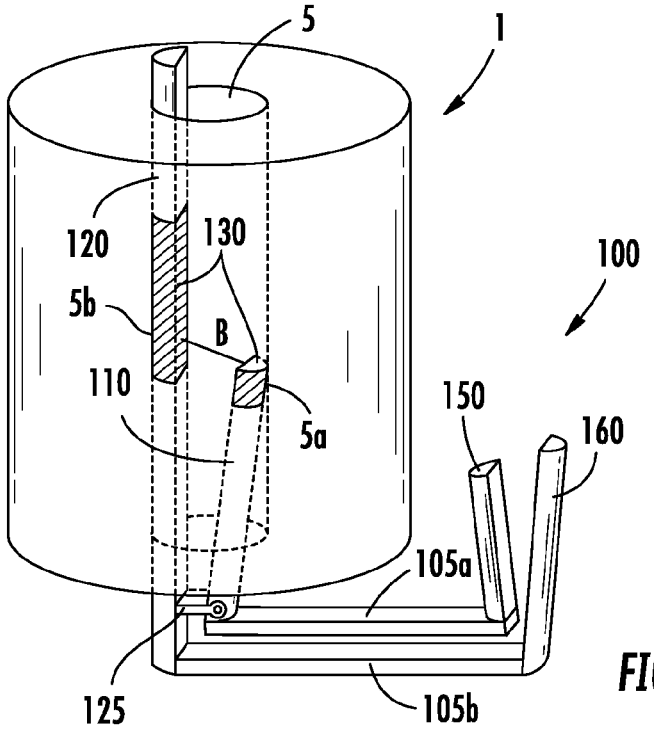
FIG. 8B is a perspective view of the packaging tool of FIG. 8A supporting a roll of packaging and in a second orientation.

The actuation mechanism is adapted to move the packaging tool 100 between a first orientation and a second orientation. The first orientation refers to a roll engaging portion 130 of the first elongate support member 110 being positioned a first distance A apart from a roll engaging portion 130 of the second elongate support member 120. See, for example, FIG. 6. The second orientation refers to the roll engaging portions 130 of the first and second elongate support members 110, 120 being separated by a second distance B, where the second distance B is greater than the first distance A. See, for example, FIG. 7. As described below, the actuation mechanism may include first and second handles 150, 160, a spring 127, a pivot device 125, or the like. FIGS. 8A and 8B show the inner U-shaped member rotating about the pivot device 125. By moving the first handle 150 toward the second handle 160 and/or closer to the second base 105*b*, the inner U-shaped member may rotate about the pivot device 125. In effect, by moving the first handle 150 toward the second handle 160 and/or the second base 105*b*, the packaging tool 100 may rotate between the first orientation (FIG. 8A) and the second orientation (FIG. 8B). In other words, the first elongate support member 110 may rotate so that its roll engaging portion(s) 130 engages an interior portion of the tubular core 5. See, for example, FIG. 8B. As shown in FIG. 8B, the second elongate support member 120 may typically be at least partially engaged with an interior portion of the tubular core 5.

Figure 8C:
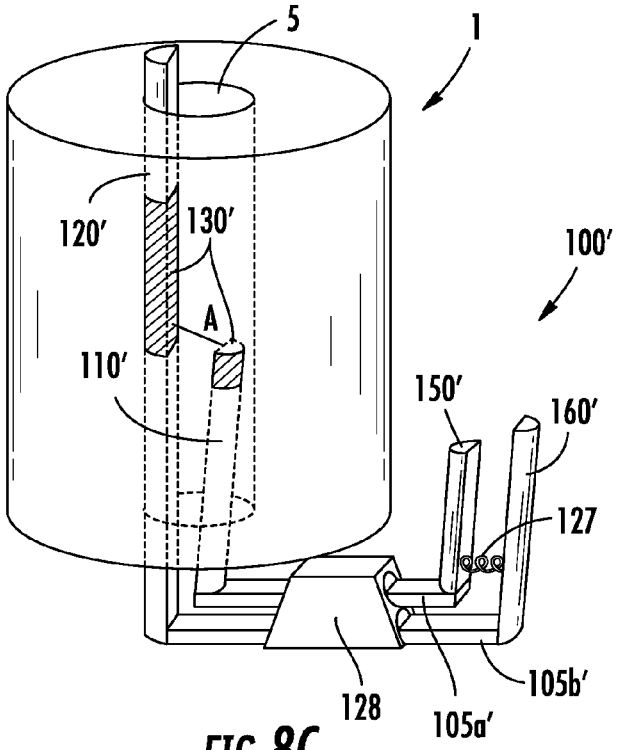
FIG. 8C is a perspective view of a packaging tool supporting a roll of packaging and in a first orientation. In this figure, the packaging tool includes a support system that supports the inner and outer U-shaped members.
Figure 8D:
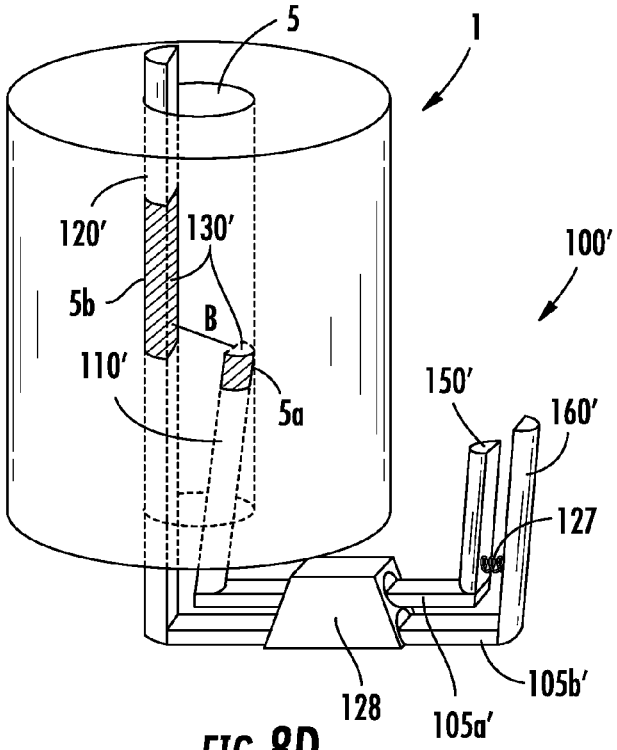
FIG. 8D is a perspective view of the packaging tool of FIG. 8C supporting a roll of packaging and in a second orientation.

FIGS. 8C and 8D show that the inner U-shaped member may translate with respect to the outer U-shaped member using a spring 127 and handles 150', 160'. As shown in FIG. 8C, the spring 127 (here, a compression spring) may be attached to the first handle 150' and the second handle 160'. Generally, the spring 127 may bias the inner U-shaped member away from the outer U-shaped member. By pulling the first handle 150' toward the second handle 160', the inner U-shaped member may move towards the second handle 160' and compress the spring 127. In effect, by pulling the handle 150' towards the second handle 160', the packaging tool 100' may move between the first orientation (FIG. 8C) and the second orientation (FIG. 8D).

As shown in FIGS. 8A-8D, the packaging tools 100, 100' are adapted so that the first and second elongate support members 110, 120 (for packaging tool 100) and 110', 120' (for packaging tool 100') may be positioned at least partially within a tubular core 5 and moved between the first and second orientations while the first and second elongate support members are disposed at least partially within the tubular core 5. When first and second elongate support members are positioned at least partially within a tubular core 5 and the packaging tool (100 or 100') is in the first orientation, the roll of packaging material 1 is substantially free to rotate. While the roll of packaging material 1 rotates, the packaging material 7 of the roll 1 may unwrap from the supportive tube 5, thereby allowing for portions of packaging material 7 to be wrapped around a package or the like. In FIGS. 9A-9B, for example, a user is shown wrapping a pallet of items 2 with a packaging tool 100' according to one embodiment of the present invention. Packaging material 7 may be initially attached or secured to a package or packages using a piece of tape or adhesive, trapping a portion of packaging material into a space between items of the pallet or between parts of one package, or the like. Typically, after the packaging material 7 is attached to the package, the user may create tension in the packaging material 7 and, consequently, rotate the roll 1 and unwrap packaging material 7 as the user moves the packaging tool 100 around the package.

When the first and second elongate support members 110, 120 (for packaging tool 100) and 110', 120' (for packaging tool 100') are positioned at least partially within the tubular core 5 and the packaging tool 100, 100' is in the second orientation, the first and second elongate support members cooperate to substantially prevent the roll of packaging material 1 from rotating. To substantially prevent the roll of packaging material 1 from rotating, as shown in FIGS. 8B and 8D, the roll engaging portion 130 of the first elongate support member 110, 110' may engage a first interior portion 5*a* of the tubular core 5 and the roll engaging portion 130 of the second elongate support member 120, 120' may engage a second interior portion 5*b* of the tubular core 5. The roll of packaging material 1 may also be prevented from rotating by being engaged by the roll engaging portion 130 of only one elongate support member. By preventing the roll 1 from rotating, the user can more easily adjust the tension on the packaging material 7, such as by moving the packaging tool 100 away from the unwrapped portion of the roll 1.

While the roll 1 is prevented from rotating, the packaging material 7 may be cut to separate an unwrapped portion of packaging material 7 from the roll 1. A user may cut the packaging material 7 using the user's free hand, such as by tearing the packaging material 7 with the user's hand, applying a cutting blade, or the like. By preventing the roll 1 from rotating and applying tension to the packaging material 7, the user can cut the packaging material 7 with less effort compared to cutting a roll 1 that is free to rotate. Even so, a user may still cut the packaging material 7 if the packaging material is not under tension and/or the roll 1 is free to rotate.

An advantageous method of using a packaging tool 100' is shown beginning at FIG. 9A, which shows a roll of packaging material 1 placed upon a packaging tool 100' where the first and second elongate support members are disposed within the tubular core 5 of the roll 1. After disposing the first and second elongate support members at least partially within the tubular core 5 of the roll 1, the roll 1 may be rotated about the first and second elongate support members. The rotation may be initiated and/or continued by spinning the roll 1 using one's hand, by using a machine to spin the roll 1, by attaching part of the packaging material 7 to an object and moving the packaging tool 100', or the like. Typically, a user may attach, such as by using tape, a portion of the packaging material 7 to a package or pallet load and begin wrapping the package or load, thereby causing the roll of packaging material 1 to rotate. Finally, the packaging tool 100' may be moved between a first orientation and a second orientation. See, for example, FIGS. 6 and 7. As stated above, the movement between orientations of the packaging tool 100' may be caused by moving the first handle.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of distributing packaging material from a roll of packaging material having a hollow, at least substantially tubular core, said method comprising:

providing said roll of packaging material;

loading said roll of packaging material onto a packaging tool that is configured to selectively at least substantially prevent the rotation of said packaging material about a central axis of said roll of packaging material, said packaging tool comprising:

(A) a first and a second elongate support member;

(B) a first and a second handle, said first handle having a longitudinal axis that is spaced apart from a longitudinal axis of said second elongate support member, and said second handle having a longitudinal axis that is parallel to and spaced apart from said longitudinal axis of the second elongate support member;

attaching an end portion of said packaging material to an object;

after attaching said end portion of said packaging material to said object, moving said packaging tool so that:

(A) said roll of packaging material rotates; and (B) as said roll of packaging material rotates, a length of said packaging material adjacent said end portion peels off of said roll of packaging material and attaches to said object;

after said packaging material attaches to said object, moving the packaging tool from: (1) a first orientation, in which the packaging tool does not substantially restrict the rotation of the roll of packaging material about said central axis; to (2) a second orientation, in which said packaging tool substantially prevents the rotation of said roll of packaging material about said central axis; and separating said length of packaging material from said roll of packaging material.

2. The method of claim 1, wherein said step of loading said roll of packaging material onto said packaging tool comprises positioning the first elongate support member and the second elongate support member within said tubular core.

3. The method of claim 2, wherein said step of moving the packaging tool from said first orientation to said second orientation comprises moving said second elongate support member relative to said first elongate support member.

4. The method of claim 3, wherein during said step of moving the packaging tool from said first orientation to said second orientation, said second elongate support member is moved relative to said first elongate support member when said first handle of said packaging tool is moved relative to said second handle of said packaging tool.

5. The method of claim 4, wherein during said step of moving the packaging tool from said first orientation to said second orientation, said longitudinal axis of said second elongate support member remains substantially parallel to and spaced apart from said longitudinal axis of said second handle.

6. The method of claim 2, wherein said step of moving the packaging tool from said first orientation to said second orientation comprises moving said first handle of said packaging tool relative to said second handle of said packaging tool such that movement of said first handle results in movement of said first elongate support member relative to said second elongate support member.

7. The method of claim 1, wherein said packaging material is shrink wrap.

8. The method of claim 1, wherein said packaging material is stretch wrap.

9. The method of claim 1, wherein said packaging material is tape.

10. The method of claim 1, wherein said step of separating said length of packaging material from said roll of packaging material comprises cutting said packaging material so that said length of packaging material physically separates from said roll of packaging material.

11. A method of distributing packaging material from a roll of packaging material having a hollow, at least substantially tubular core, said method comprising:

providing said roll of packaging material;

providing a packaging tool comprising:

(A) a base;

(B) a first elongate support member extending outwardly relative to a surface of said base;

(C) a second elongate support member extending outwardly relative to a surface of said base;

(D) an actuation mechanism comprising a first handle and a second handle, said first handle having a longitudinal axis spaced apart from a longitudinal axis of said second elongate support member, said second handle having a longitudinal axis parallel to and spaced apart from said longitudinal axis of said second elongate support member, and wherein said actuation mechanism is configured to move the packaging tool between a first orientation and a second orientation;

loading said roll of packaging material onto said packaging tool;

attaching an end portion of said packaging material to an object;

after attaching said end portion of said packaging material to said object, moving said packaging tool so that:

(A) said roll of packaging material rotates; and (B) as said roll of packaging material rotates, a length of said packaging material adjacent said end portion peels off of said roll of packaging material and attaches to said object;

after said packaging material attaches to said object, manipulating said actuation mechanism to move the packaging tool from: (1) said first orientation, in which the packaging tool does not substantially restrict the rotation of the roll of packaging material about said central axis; to (2) said second orientation, in which said packaging tool substantially prevents the rotation of said roll of packaging material about said central axis; and separating said length of packaging material from said roll of packaging material.

12. The method of claim 11, wherein said step of loading said roll of packaging material onto said packaging tool comprises positioning said first elongate support member and said second elongate support member within said tubular core.

13. The method of claim 11, wherein said step of manipulating said actuation mechanism to move the packaging tool from said first orientation to said second orientation comprises moving said first handle of said packaging tool relative to said second handle of said packaging tool such that movement of said first handle results in movement of said first elongate support member relative to said second elongate support member.

14. The method of claim 11, wherein during said step of manipulating said actuation mechanism to move the packaging tool from said first orientation to said second orientation, said longitudinal axis of said second elongate support member remains substantially parallel to said longitudinal axis of said second handle.

15. A method of distributing packaging material from a roll of packaging material having a hollow, at least substantially tubular core, said method comprising:

providing said roll of packaging material;

providing a packaging tool comprising:

(A) a first and a second elongate support member;

(B) a first handle operatively coupled to said first elongate support member, wherein a longitudinal axis of said first handle is spaced apart from a longitudinal axis of said second elongate support member; and (C) a second handle operatively coupled to said second elongate support member, wherein a longitudinal axis of said second handle is parallel to and spaced apart from said longitudinal axis of said second elongate support member;

loading said roll of packaging material onto said packaging tool;

attaching an end portion of said packaging material to an object;

after attaching said end portion of said packaging material to said object, moving said packaging tool so that:

(A) said roll of packaging material rotates; and (B) as said roll of packaging material rotates, a length of said packaging material adjacent said end portion peels off of said roll of packaging material and attaches to said object; and after said packaging material attaches to said object, moving the packaging tool from: (1) a first orientation, in which the packaging tool does not substantially restrict the rotation of the roll of packaging material about said central axis; to (2) a second orientation, in which said packaging tool substantially prevents the rotation of said roll of packaging material about said central axis.

16. The method of claim 15, wherein said step of loading said roll of packaging material onto said packaging tool comprises positioning said first elongate support member and said second elongate support member within said tubular core.

17. The method of claim 15, wherein said step of moving the packaging tool from said first orientation to said second orientation comprises moving said first handle of said packaging tool relative to said second handle of said packaging tool such that movement of said first handle results in movement of said first elongate support member relative to said second elongate support member.

18. The method of claim 15, wherein during said step of moving the packaging tool from said first orientation to said second orientation, said longitudinal axis of said second elongate support member remains substantially parallel to and spaced apart from said longitudinal axis of said second handle.

19. A method of distributing packaging material from a roll of packaging material having a hollow, at least substantially tubular core, said method comprising:

providing said roll of packaging material;

providing a packaging tool comprising:

(A) a base;

(B) a first elongate support member extending in a first direction relative to a surface of said base;

(C) a second elongate support member extending in said first direction relative to said surface of said base;

(D) an actuation mechanism comprising a first handle and a second handle, said first handle and said second handle each extending in said first direction relative to said surface of said base, said first handle and said second handle each having respective longitudinal axes spaced apart from a longitudinal axis of said second elongate support member, and wherein said actuation mechanism is configured to move the packaging tool between a first orientation and a second orientation;

loading said roll of packaging material onto said packaging tool;

attaching an end portion of said packaging material to an object;

after attaching said end portion of said packaging material to said object, moving said packaging tool so that:

(A) said roll of packaging material rotates; and (B) as said roll of packaging material rotates, a length of said packaging material adjacent said end portion peels off of said roll of packaging material and attaches to said object;

after said packaging material attaches to said object, manipulating said actuation mechanism to move the packaging tool from: (1) said first orientation, in which the packaging tool does not substantially restrict the rotation of the roll of packaging material about said central axis; to (2) said second orientation, in which said packaging tool substantially prevents the rotation of said roll of packaging material about said central axis; and separating said length of packaging material from said roll of packaging material.

* * * * *